US010487834B2

(12) United States Patent
Yang et al.

(10) Patent No.: US 10,487,834 B2
(45) Date of Patent: Nov. 26, 2019

(54) SCREW COMPRESSOR AND A COMPRESSOR BODY THEREOF

(71) Applicant: Gree Electric Appliances, Inc. of Zhuhai, Guangdong (CN)

(72) Inventors: Qiaoming Yang, Guangdong (CN); Rihua Li, Guangdong (CN); Tianyi Zhang, Guangdong (CN); Hua Liu, Guangdong (CN); Yushi Bi, Guangdong (CN); Yanhai Peng, Guangdong (CN); Shuru Lin, Guangdong (CN); Kang Xu, Guangdong (CN); Bin Ma, Guangdong (CN); Qiangjun Meng, Guangdong (CN); Zhaorui Zhao, Guangdong (CN); Wenqing Chen, Guangdong (CN); Ziwen Xing, Guangdong (CN)

(73) Assignee: Gree Electric Appliances, Inc. of Zhuhai (CN)

( * ) Notice: Subject to any disclaimer, the term of this patent is extended or adjusted under 35 U.S.C. 154(b) by 0 days.

(21) Appl. No.: 15/576,143

(22) PCT Filed: May 17, 2016

(86) PCT No.: PCT/CN2016/082363
§ 371 (c)(1),
(2) Date: Nov. 21, 2017

(87) PCT Pub. No.: WO2017/045411
PCT Pub. Date: Mar. 23, 2017

(65) Prior Publication Data

US 2018/0135631 A1 May 17, 2018

(30) Foreign Application Priority Data

Sep. 15, 2015 (CN) ..... 2015 1 0585999

(51) Int. Cl.
*F04C 29/00* (2006.01)
*F04C 29/04* (2006.01)
(Continued)

(52) U.S. Cl.
CPC ..... *F04C 29/04* (2013.01); *F01C 21/10* (2013.01); *F04C 18/16* (2013.01); *F04C 29/06* (2013.01);
(Continued)

(58) Field of Classification Search
CPC ..... F04C 29/04; F04C 29/06; F04C 29/12; F04C 29/124; F04C 28/12; F04C 18/16;
(Continued)

(56) References Cited

U.S. PATENT DOCUMENTS 2,489,887 A * 11/1949 Houghton ..... F04C 29/042 418/180
4,767,284 A 8/1988 Shiinoki et al.
(Continued)

FOREIGN PATENT DOCUMENTS

CN 87202429 U 3/1988
CN 1703584 A 11/2005
(Continued)

OTHER PUBLICATIONS

English translation of JP07332273 by Espacenet, Apr. 9, 2019.*

*Primary Examiner* — Deming Wan
(74) *Attorney, Agent, or Firm* — The Webb Law Firm

(57) ABSTRACT

A screw compressor and a compressor body thereof, in which the compressor body includes a housing provided with a suction inlet and a discharge end face, the housing is internally provided with a rotor chamber and a spool chamber, the housing is provided with a cooling chamber around the rotor chamber, the cooling chamber communicates with
(Continued)

the suction inlet, and the cooling chamber is provided with an air inlet communicating with the rotor chamber.

5 Claims, 3 Drawing Sheets

(51) Int. Cl.

| | |
|---|---|
| ***F04C 18/16*** | (2006.01) |
| ***F04C 29/06*** | (2006.01) |
| ***F04C 29/12*** | (2006.01) |
| ***F01C 21/10*** | (2006.01) |

(52) U.S. Cl.
CPC ..... *F04C 29/12* (2013.01); *F04C 29/124* (2013.01); *F04C 2240/20* (2013.01); *F04C 2240/30* (2013.01)

(58) Field of Classification Search
CPC .. F04C 28/125; F04C 29/0007; F04C 29/042; F01C 1/16; F01C 21/10
USPC ..... 418/101, 83, 85, 86, 201.1, 202.2
See application file for complete search history.

(56) References Cited

U.S. PATENT DOCUMENTS

| | | | | |
|---|---|---|---|---|
| 8,459,963 | B2 * | 6/2013 | Pileski | F04C 18/16 417/312 |
| 9,140,260 | B2 * | 9/2015 | Huang | F04C 18/086 |
| 2003/0035731 | A1 | 2/2003 | Kim | |
| 2006/0153696 | A1 | 7/2006 | Ransom et al. | |

FOREIGN PATENT DOCUMENTS

| | | | | |
|---|---|---|---|---|
| CN | 201786665 | U | 4/2011 | |
| CN | 105041648 | A | 11/2015 | |
| CN | 205013288 | U | 2/2016 | |
| EP | 2287444 | A1 | 2/2011 | |
| JP | 5149287 | A | 6/1993 | |
| JP | 07332273 | A * | 12/1995 | F04C 18/086 |
| JP | 7332273 | A | 12/1995 | |
| WO | 03102422 | A1 | 12/2003 | |
| WO | 2015015964 | A1 | 2/2015 | |

* cited by examiner

SCREW COMPRESSOR AND A COMPRESSOR BODY THEREOF

CROSS-REFERENCE TO RELATED APPLICATIONS

This application is the United States national phase of International Application No. PCT/CN2016/082363 filed May 17, 2016, and claims priority to Chinese Patent Application No. 201510585999.5 filed Sep. 15, 2015, the disclosure of which are hereby incorporated in their entirety by reference.

BACKGROUND OF THE INVENTION

Field of the Invention

The present application relates to the technical field of a compressor, and more particularly, relates to a screw compressor and a compressor body thereof.

Description of Related Art

The screw compressor generally presents two air suction manners, in which the first is in a way such that the sucked air after cooling the motor enters the rotor chamber; and the second is in a way such that the sucked air directly entered the rotor chamber. Such two suction manners cannot sufficiently cool the rotor chamber. Due to the limit by the wall structure of the rotor chamber of the compressor, noise in the operation process of the compressor is easily radiated out.

Accordingly, how to reduce noise of the compressor whilst sufficiently cooling the rotor chamber becomes a technical issue urgently to be solved.

SUMMARY OF THE INVENTION

In view of this, a first object of the present application is to provide a compressor body to effectuate reducing noise of the compressor whilst sufficiently cooling the rotor chamber; a second object of the present application is to provide a screw compressor comprising the aforementioned compressor body.

In order to realize the aforementioned first object, the present application provides the following technical solution:

A compressor body comprises a housing provided with an suction inlet and an discharge end face, the housing is internally provided with a rotor chamber and a spool chamber, the housing is provided with a cooling chamber around the rotor chamber, the cooling chamber communicates with the suction inlet, and the cooling chamber is provided with an air inlet communicating with the rotor chamber.

Preferably, in the aforementioned compressor body, the amount of the air inlet is plural.

Preferably, in the aforementioned compressor body, a plurality of the air inlets are a primary air inlet, a first auxiliary air inlet and a second auxiliary air inlet, the primary air inlet having a diameter greater than that of both the first auxiliary air inlet and the second auxiliary air inlet.

Preferably, in the aforementioned compressor body, the rotor chamber comprises a female rotor chamber and a male rotor chamber; the primary air inlet is disposed in the middle of the female rotor chamber and the male rotor chamber proximate to the discharge end face, the first auxiliary air inlet is disposed at the bottom of the female rotor chamber, and the second auxiliary air inlet is disposed at the bottom of the male rotor chamber.

Preferably, in the aforementioned compressor body, the discharge end face is provided with an opening communicating with the cooling chamber, and there is a tapering cross section from the opening to the cooling chamber.

Preferably, in the aforementioned compressor body, the suction inlet is disposed at one side of the housing.

Preferably, in the aforementioned compressor body, the cooling chamber surrounds the spool chamber.

As can be seen from the aforementioned solution, a coolant after entering the suction inlet, first enters the cooling chamber, and then enters the rotor chamber via the air inlet. By means of such structural design, the coolant subject to air suction forms a flow in the cooling chamber. As the coolant subject to air suction has a lower temperature, and the outer wall of the rotor chamber has a higher temperature, by means of a coolant flow, the rotor chamber can be sufficiently cooled to avoid an excessively high discharge temperature. Moreover, the coolant flow can also sufficiently absorb noise and vibration radiated from the rotor chamber, thus further reduce overall machine noise of the compressor.

In order to realize the aforementioned second object, the present application further provides a screw compressor comprising a compressor body, a spool valve, a male rotor, a female rotor and a filter element, the compressor body is the compressor body of the aforementioned any technical solution, the spool valve is disposed at the spool chamber, the male rotor is disposed at the male rotor chamber, and the female rotor is disposed at the female rotor chamber. As the aforementioned compressor body has the aforementioned effect, the screw compressor also presents the same effect.

BRIEF DESCRIPTION OF THE ACCOMPANYING DRAWINGS

In order to more clearly explain the embodiments of the present application or the technical solutions in the prior art, a brief introduction will be given below for the drawings required to be used in the description of the embodiments or the prior art. It is obvious that, the drawings illustrated as follows are merely some of the embodiments of the present application. For a person skilled in the art, he or she may also acquire other drawings according to such drawings on the premise that no inventive effort is involved.

Among them, 1 is a housing; 11 is a suction inlet; 12 is an discharge end face; 131 is a male rotor chamber; 132 is a female rotor chamber; 14 is a spool chamber; 15 is a cooling chamber; 151 is a primary air inlet; 152 is a second auxiliary air inlet; and 153 is a first auxiliary air inlet; 16 is a spool valve.

DETAILED DESCRIPTION OF THE PREFERRED EMBODIMENTS

The core object of the present application is to provide a screw compressor and a compressor body thereof, such as to effectuate reducing noise of the compressor whilst sufficiently cooling the rotor chamber.

Next, explanations are made to the embodiments with reference to the drawings. Further, the embodiments shown below do not produce any delimiting effect over the content of the application recited in the claims. In addition, all the constituted content presented by the embodiments below is not limited as required by the solution of the application recited in the claims.

Figure 1:
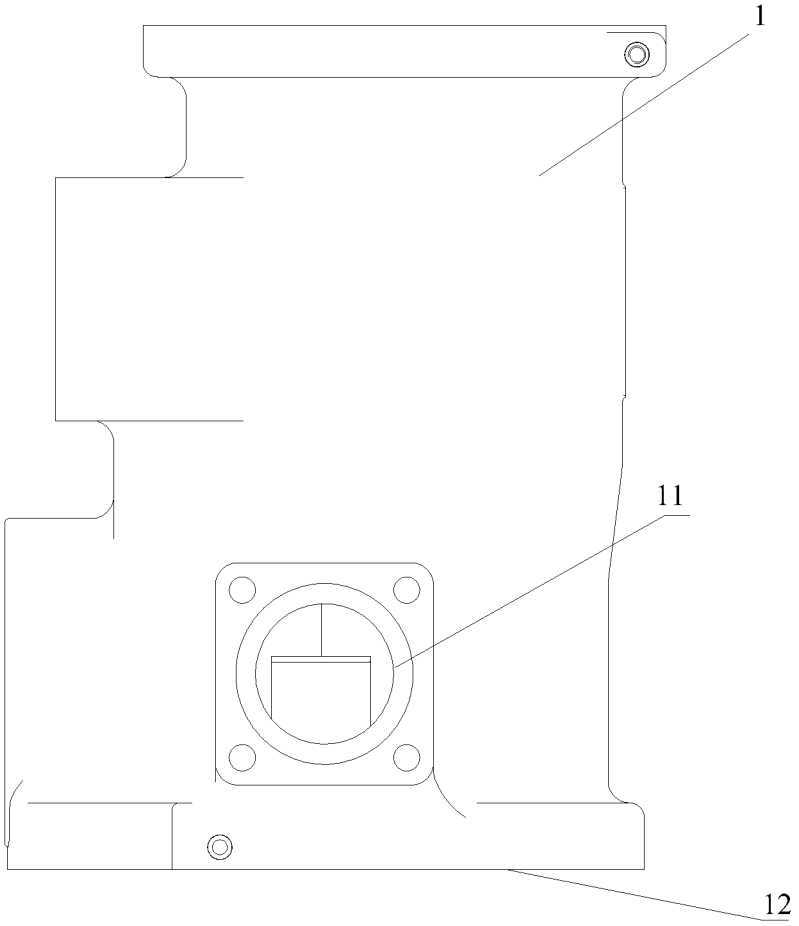
FIG. 1 is a schematic view of a front view structure of the compressor body provided by the embodiments of the present application.
Figure 2:
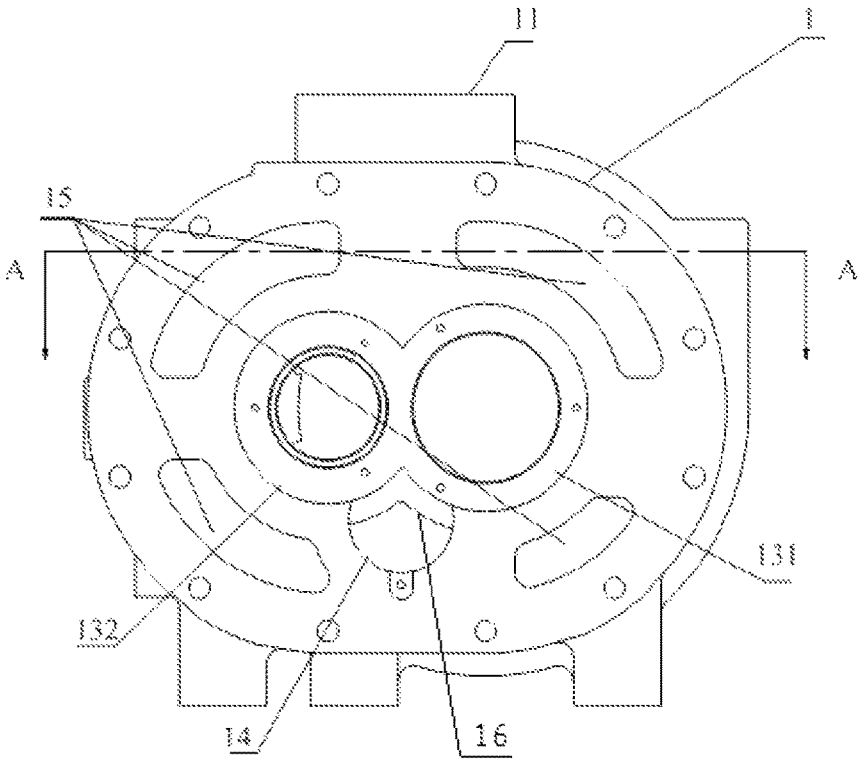
FIG. 2 is a schematic view of a top-view structure of the reinforcing plate provided by the embodiments of the present application.
Figure 3:
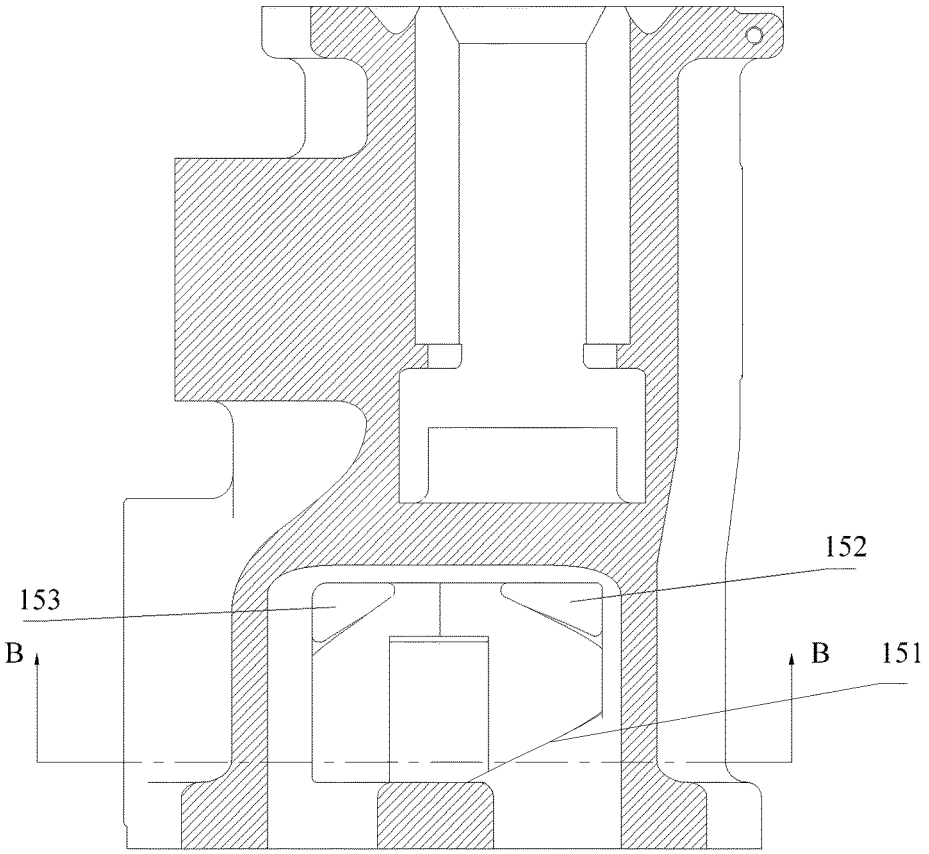
FIG. 3 is a sectional view of the cross section A-A in FIG. 2.
Figure 4:
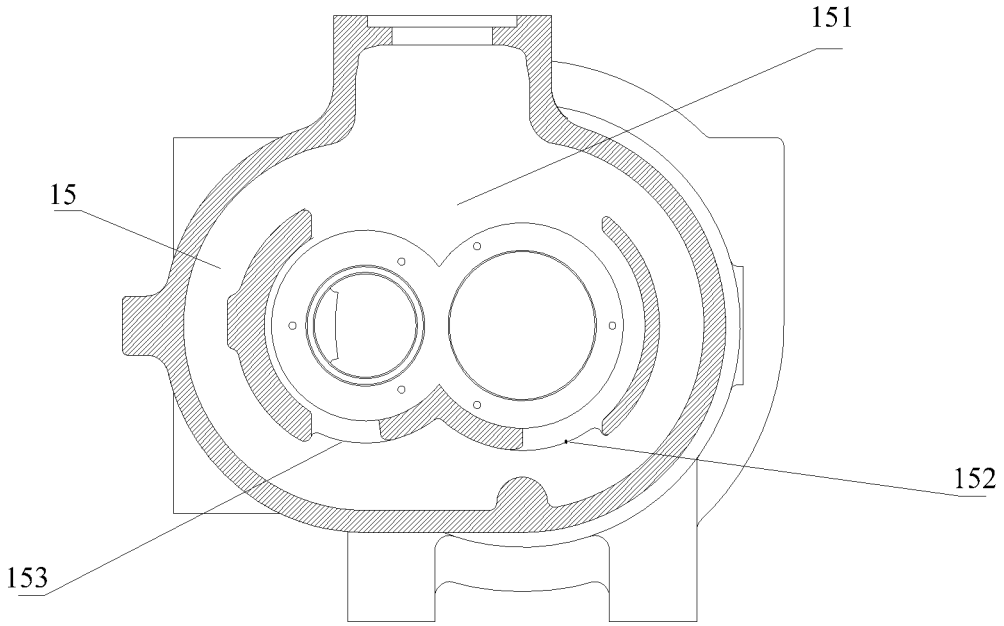
FIG. 4 is a sectional view of the cross section B-B in FIG. 3.

With reference to FIGS. 1-4, the compressor body comprises a housing 1 provided with an suction inlet 11 and an discharge end face 12, the housing 1 is internally provided with a rotor chamber and a spool chamber 14, the housing 1 is provided with a cooling chamber 15 around the rotor chamber, the cooling chamber 15 communicates with the suction inlet 11, and the cooling chamber 15 is provided with an air inlet communicating with the rotor chamber.

A coolant after entering the suction inlet 11, first enters the cooling chamber 15, and then enters the rotor chamber via the air inlet. By means of such structural design, the coolant subject to air suction forms a flow in the cooling chamber 15. As the coolant subject to air suction has a lower temperature, and the outer wall of the rotor chamber has a higher temperature, by means of a coolant flow, the rotor chamber can be sufficiently cooled to avoid an excessively high discharge temperature. Moreover, the coolant flow can also sufficiently absorb noise and vibration radiated from the rotor chamber, so as to further reduce overall machine noise of the compressor.

In the embodiments of the present application, in order to ensure an adequate amount of coolant entering the rotor chamber, the amount of the suction inlet is plural. In order to form an intenser coolant flow to get thermal emission of the rotor chamber accelerated, in the aforementioned compressor body, a plurality of air inlets are a primary air inlet 151, a first auxiliary air inlet 153 and a second auxiliary air inlet 152, wherein the primary air inlet 151 has a diameter greater than that of both the first auxiliary air inlet 153 and the second auxiliary air inlet 152. As the primary air inlet 151 has a greater diameter, there is relatively more coolant entering the rotor chamber, whereas, the first auxiliary air inlet 153 and the second auxiliary air inlet 152 has a relatively smaller diameter, a coolant flow can be formed within the rotor chamber to cool the interior of the rotor chamber. However, at the same time inside the cooling chamber 15, as the coolant entering the rotary chamber from the cooling chamber 15 has different sizes, a coolant flow may also be formed inside the cooling chamber 15, thus effectuate cooling the wall of the rotary chamber.

In order to further optimize the aforementioned solution, the rotor chamber comprises a female rotor chamber 132 and a male rotor chamber 131; the primary air inlet 151 is disposed in the middle of the female rotor chamber 132 and the male rotor chamber 131 proximate to the discharge end face 12, the first auxiliary air inlet 153 is disposed at the bottom of the female rotor chamber 132, and the second auxiliary air inlet 152 is disposed at the bottom of the male rotor chamber 131. It is accordingly configured such that, air can be sucked at different locations of the rotor chamber, and meanwhile the primary air inlet 151 and the first auxiliary air inlet 153 as well as the second auxiliary air inlet 152 therebetween are not only distributed at different locations of the rotor chamber in a circumferential direction, but at the same time are present with a gradient difference in an axial direction. Accordingly, the coolant within the cooling chamber 15 and the rotor chamber is in relatively intenser movement, so as to further improve the cooling efficiency.

The compressor body of the compressor may be a forged part, a cast part, and the like. In the case of a forged part, in order to facilitate the demolding, the discharge end face 12 is provided with an opening communicating with the cooling chamber 15, and there is a tapering cross section from the opening to the cooling chamber 15.

The compressor body of the aforementioned structure is adapted for various compressors. In the embodiments of the present application, the suction inlet 11 is disposed at one side of the housing 1.

In order to further optimize the aforementioned solution, the cooling chamber 15 further surrounds the spool chamber 14 which may be cooled by surrounding the same.

The present application further discloses a screw compressor comprising a compressor body, a spool valve 16, a male rotor, a female rotor and a filter element, the compressor body is the compressor body of the aforementioned any technical solution, the spool valve 16 is disposed at the spool chamber 14, the male rotor is disposed at the male rotor chamber 131, and the female rotor is disposed at the female rotor chamber 132. As the aforementioned compressor body has the aforementioned effect, the screw compressor also presents the same effect, and thus will no longer be repeated here.

The foregoing explanations of the disclosed embodiments enable a person skilled in the art to realize or use the present application. Multiple modifications to these embodiments are obvious for a profession person skilled in the art. The general principles defined in the present text may be realized in other embodiments without departing from the spirit or scope of the present application. Accordingly, the present application will not be limited to such embodiments shown in the present text, but is required to conform to the broadest scope consistent with the principles and novel features as disclosed in the present text.

The invention claimed is:

1. A compressor body comprising:

a housing provided with:

a suction inlet; and a discharge end face;

said housing being internally provided with:

a rotor chamber;

a cooling chamber around said rotor chamber, said cooling chamber provided with a plurality of air inlets communicating with said rotor chamber, the plurality of air inlets comprising a primary air inlet, a first auxiliary air inlet, and a second auxiliary air inlet, said primary air inlet having a diameter greater than that of both said first auxiliary air inlet and said second auxiliary air inlet, and said primary air inlet, said first auxiliary air inlet, and said second auxiliary air inlet being distributed at different locations of said rotor chamber in a circumferential direction; and a spool chamber;

wherein said cooling chamber communicates with said suction inlet, said discharge end face has an opening for communication between said cooling chamber and said discharge end face, and there is a tapering cross section from said opening to said cooling chamber.

2. The compressor body of claim 1, wherein said rotor chamber comprises a female rotor chamber and a male rotor chamber; said primary air inlet is disposed in a middle of said female rotor chamber and said male rotor chamber proximate to said discharge end face, said first auxiliary air inlet is disposed at a bottom of said female rotor chamber, and said second auxiliary air inlet is disposed at the bottom of said male rotor chamber.

3. The compressor body of claim 1, wherein said suction inlet is disposed at one side of said housing.

4. The compressor body of claim 3, wherein said cooling chamber surrounds said spool chamber.

5. A screw compressor comprising a compressor body, a spool valve, a male rotor and a female rotor, wherein said compressor body is the compressor body of claim 1, said spool valve is disposed in said spool chamber, said male rotor is disposed in said male rotor chamber, and said female rotor is disposed in said female rotor chamber.

* * * * *